US007332465B2

(12) United States Patent
Wulff et al.

(10) Patent No.: US 7,332,465 B2
(45) Date of Patent: Feb. 19, 2008

(54) ALKOXYLATES EXHIBITING LOW RESIDUAL ALCOHOL CONTENT

(75) Inventors: Christian Wulff, Mannheim (DE); Kai-Uwe Baldenius, Ludwigshafen (DE); Martin Scholtissek, Wachenheim (DE); Michael Stoesser, Neuhofen (DE); Norbert Wagner, Mutterstadt (DE); Edward Bohres, Mannheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 290 days.

(21) Appl. No.: 10/527,959

(22) PCT Filed: Apr. 25, 2003

(86) PCT No.: PCT/EP03/04330

§ 371 (c)(1),
(2), (4) Date: Mar. 15, 2005

(87) PCT Pub. No.: WO2004/033405

PCT Pub. Date: Apr. 22, 2004

(65) Prior Publication Data

US 2005/0272626 A1 Dec. 8, 2005

(30) Foreign Application Priority Data

Sep. 18, 2002 (DE) ..... 102 43 365

(51) Int. Cl.
*C11D 1/722* (2006.01)
*C11D 3/02* (2006.01)
*C11D 7/02* (2006.01)

(52) U.S. Cl. ..... 510/421; 510/342; 510/360; 510/475; 510/505

(58) Field of Classification Search ..... 510/342, 510/360, 421, 475, 505
See application file for complete search history.

(56) References Cited

U.S. PATENT DOCUMENTS

| | | | | |
|---|---|---|---|---|
| 2,508,036 A | | 5/1950 | Kosmin | |
| 5,705,476 A | * | 1/1998 | Hoffarth | 510/535 |
| 6,680,412 B2 | * | 1/2004 | Gumbel et al. | 568/672 |

FOREIGN PATENT DOCUMENTS

| | | | |
|---|---|---|---|
| DE | 102 18 752 | | 11/2003 |
| DE | 102 18 753 | | 11/2003 |
| DE | 102 18 754 | | 11/2003 |
| WO | 94/11330 | | 5/1994 |
| WO | 94/11331 | | 5/1994 |
| WO | WO 94/11331 | * | 5/1994 |
| WO | 01/04183 | | 1/2001 |
| WO | WO 01/04183 | * | 1/2001 |
| WO | 02/50006 | | 6/2002 |

* cited by examiner

*Primary Examiner*—Brian Mruk
(74) *Attorney, Agent, or Firm*—Oblon, Spivak, McClelland, Maier & Neustadt, P.C.

(57) ABSTRACT

The present invention relates to compositions at least comprising one alkoxylate of the formula $RO(A)_n(B)_mH$, to processes for the preparation of such compositions, in particular in the presence of double-metal cyanide compounds as catalyst, and their use as emulsifier, foam regulator or as wetting agents for hard surfaces. Moreover, the present invention also relates to the use of such compositions in detergents and surfactant formulations.

3 Claims, No Drawings

ALKOXYLATES EXHIBITING LOW RESIDUAL ALCOHOL CONTENT

The present invention relates to compositions at least comprising one alkoxylate of the formula $RO(A)_n(B)_mH$, to processes for the preparation of such compositions, in particular in the presence of double-metal cyanide compounds as catalyst, and to their use as emulsifier, foam regulator or as wetting agent for hard surfaces. Moreover, the present invention also relates to the use of such compositions in detergents and surfactant formulations.

Processes for the alkoxylation of aliphatic alcohols and the resulting alkoxylates are known in principle from the prior art. WO 01/04183, for example, describes a process for the ethoxylation of hydroxyfunctional starter compounds which is carried out in the presence of a double-metal cyanide compound as catalyst.

Alkoxylates of aliphatic alcohols are used widely as surfactants, emulsifiers or foam suppressors. The wetting and emulsifier properties depend heavily on the nature of the alcohol and the nature and amount of the alkoxide adducts.

WO 94/11331 relates to the use of alkoxylates of 2-propylheptanol in detergent compositions for degreasing hard surfaces. The alkoxylates have 2 to 16 alkylene oxide groups. Preferably, the majority of the alkylene oxide groups is in the form of ethylene oxide. According to the examples, exclusively ethoxylated alcohols are used. It is also described that the alcohols can firstly be reacted with ethylene oxide and then with propylene oxide. However, no examples or properties are given for such alkoxylates. It is stated that the described alkoxylates exhibit good detergency and wetting effect, combined with low foaming. In addition, it is stated that the alkoxylates have a desired thickening effect in formulations.

WO 94/11330 relates to alkoxylates of 2-propylheptanol and their use. In the alkoxylates, 2-propylheptanol reacted firstly with 1 to 6 mol of propylene oxide and then with 1 to 10 mol of ethylene oxide is present. According to the examples, a 2-propylheptanol reacted firstly with 4 mol of propylene oxide and then 6 mol of ethylene oxide is used. It is stated that the alkylene oxide adducts exhibit an improved relationship of foaming behavior to detergency effect. In addition, it is stated that the alkoxylates exhibit good wetting behavior. They are used in detergent compositions for the cleaning of textile materials.

U.S. Pat. No. 2,508,036 relates to the use of 2-n-propylheptanol ethoxylates which contain 5 to 15 mol of ethylene oxide as wetting agents in aqueous solutions. It is described that the products can be used as surfactants in detergents.

DE 102 18 754.1 and DE 102 18 753.3 relate to the use of $C_{10}$-alkanol alkoxylate mixtures, in particular alkanol ethoxylate mixtures, such $C_{10}$-alkanol alkoxylate mixtures and processes for their preparation. DE 102 18 752.5 likewise describes alkoxylate mixtures and detergents comprising these and also processes for the preparation of the alkoxylate mixtures and the use of the detergent for the washing or cleaning of textiles.

The ethoxylation of alcohols, in particular, has the problem that the alcohols do not completely react. This leads to a high content of residual alcohol in the resulting alkoxylation products. The avoidance of relatively large amounts of residual alcohol present in the product is advantageous, in particular, for odor reasons. The alcohol mixtures used according to the invention generally have an intrinsic odor which can be suppressed to the greatest possible extent through complete alkoxylation. Alkoxylates obtained by customary processes often have an intrinsic odor which is troublesome for many applications. Furthermore, improved wetting on hard surfaces, improved emulsifying behavior and a lower CMC (critical micelle concentration) are desirable.

Starting from this prior art, the object of the present invention was to provide compositions which have little residual alcohol.

We have found that this object is achieved by compositions at least comprising one alkoxylate of the formula I:

$$RO(A)_n(B)_mH \quad (I)$$

in which

R is a linear or branched alkyl radical having 6 to 19 or 18 carbon atoms,

A is propyleneoxy,

B is ethyleneoxy or a mixture of ethyleneoxy and propyleneoxy, n is an integer or fraction where $0<n\leqq 5$, m is an integer or fraction where $0<m\leqq 20$, where, if R is an alkyl radical of the formula $C_5HICH(C_3H_7)CH_2$—, n is an integer or fraction where $0<n<1$, with the proviso that for R, isomer mixtures of an alkyl radical of the empirical formula $C_5H_{11}CH(C_3H_7)CH_2$— comprising

| | |
|---|---|
| 70 to 99% by weight | of a radical R1 in which $C_5H_{11}$ has the meaning n-$C_5H_{11}$ and |
| 1 to 30% by weight | of a radical R2 in which $C_5H_{11}$ has the meaning $C_2H_5CH(CH_3)CH_2$ and/or $CH_3CH(CH_3)CH_2CH_2$, |

are excluded.

In the general formula I, n and m are a mean value which arises as an average over all molecules. For this reason, n and m may also deviate from integers.

For the purposes of the present invention, propyleneoxy is —$CH_2$—$CH(CH_3)$—O— or —$CH(CH_3)$—$CH_2$—O—. Ethyleneoxy is —$CH_2$—$CH_2$—O—.

In the alkoxylate of the formula I at least present in the compositions according to the invention, propylene oxide is bonded to the radical RO in a ring-opening manner. n gives the number of propylene oxide groups and is an integer or fraction where $0<n\leqq 5$, for example $0<n\leqq 2$, preferably $0<n\leqq 1.5$, particularly preferably $0<n\leqq 1.2$, in particular $0<n<1$. If R is an alkyl radical of the formula $C_5H_{11}CH(C_3H_7)CH_2$—, n is an integer or fraction where $0<n<1$.

Ethylene oxide or a mixture of ethylene oxide and propylene oxide is bonded to the propylene oxide group. m is the number of ethylene oxide or ethylene oxide and propylene oxide groups and is an integer or fraction where $0<m\leqq 20$, preferably $1\leqq m\leqq 18$, in particular $2\leqq m\leqq 14$, for example $2.5\leqq m\leqq 14$ or $3\leqq m\leqq 8$.

In a preferred embodiment, the present invention therefore provides compositions where m is an integer or fraction from 2 to 14.

The compositions according to the invention have a low content of residual alcohol. It is surprising that the residual alcohol content in the compositions according to the invention, which have a defined amount of propylene oxide and then ethylene oxide or ethylene oxide and propylene oxide, is lower than would be expected in theory. From residual alcohol contents of products which contain only propylene oxide or only ethylene oxide it is possible to determine an expected value which is higher than the residual alcohol content actually determined for the copolymers.

The alkoxylates present in the compositions according to the invention require only one propylene oxide (PO) block of very short length bonded directly to the alcohol to reduce the residual alcohol content. This is, in particular, therefore very advantageous if the biodegradability of the product decreases as the length of the PO block increases. Such alkoxylates thus permit maximum degrees of freedom in the choice of the length of the PO block, the length being limited downward by the increasing residual alcohol content and upward by the deterioration in the biodegradability. This is particularly advantageous when only a short ethylene oxide block follows the PO block.

In the alkoxylates present in the compositions according to the invention, it is possible then firstly for propyleneoxy units to be present on the alcohol radical, followed by ethyleneoxy units. If n and m have a value greater than 1, then the corresponding alkoxy radicals are preferably in block form. During the alkoxylation of alkanols, a distribution of the degree of alkoxylation is generally obtained which can be adjusted to a certain extent through the use of various alkoxylation catalysts. Through the choice of suitable amounts of groups A and B it is possible to match the spectrum of properties of compositions according to the invention to the practical requirements. Particularly preferably, the reaction is firstly carried out with propylene oxide and then with ethylene oxide.

In an advantageous embodiment, the present invention thus relates to compositions where B is ethyleneoxy.

For the purposes of the present invention, the alkyl radical R is a linear or branched alkyl radical having 6 to 19 or 18 carbon atoms, with the exception of isomer mixtures of an alkyl radical of the empirical formula $C_5H_{11}CH(C_3H_7)CH_2$— comprising

| | |
|---|---|
| 70 to 99% by weight | of a radical R1 in which $C_5H_{11}$ has the meaning n-$C_5H_{11}$ and |
| 1 to 30% by weight | of a radical R2 in which $C_5H_{11}$ has the meaning $C_2H_5CH(CH_3)CH_2$ and/or $CH_3CH(CH_3)CH_2CH_2$. |

Suitable alcohols, that are branched, have the hydroxy group e.g. in 2-, 3-, 4-position etc. The alkyl radical can be linear or one more branched and can carry e.g. methyl- or ethylsubstituents.

Examples of suitable alcohols are 2-decanol, 2-dodecanol, 2-tetradecanol, 2-hexadecanol, in each case obtainable by addition of water to α-olefins, (6-ethyl)-2-nonaol, obtainable by reaction of 2-ethylhexanol with acetone and subsequent hydrogenation, (7-ethyl)-3-decanol, respectively (3-methyl-6-ethyl)-2-nonanol, obtainable by reaction of 2-ethylhexanol with methylethylketone and subsequent hydrogenation, 2-hexadecanol, respectively 2-octadecanol, obtainable by reaction of $C_{13}/C_{15}$-aldehyde with acetone, 3-nonadecanol, respectively (3-methyl)-2-octadecanol, (3-methyl)-2-hexadecanol, 3-heptadecanol, obtainable by reaction of $C_{13}/C_{15}$-aldehyde with methylethylketone. The reaction products based on $C_{13}/C_{15}$-aldehydes are branched in α-position in a proportion of 40-50% when used as a technical mixture.

Examples of further suitable alcohols are linear $C_{12}$-$C_{14}$-alkanes having a hydroxy group in an non-terminal position along the claim, respectively mixtures thereof (e.g. Softanol®—alcohols by Nippen Shokubai or Tergitol®—alcohols by DOW.)

In particular, R is an alkyl radical having 8 to 15 carbon atoms, preferably 10 to 15 carbon atoms, such as, for example, propylheptyl.

Alkyl radicals R suitable according to the invention are derived, for example, from the alcohols octanol, 2-ethylhexanol, nonanol, decanol, undecanol, dodecanol, tridecanol, tetradecanol, pentadecanol, isooctanol, isononanol, isodecanol, isoundecanol, isododecanol, 2-butyloctanol, isotridecanol, isotetradecanol, isopentadecanol, preferably isodecanol, 2-propylheptanol, tridecanol, isotridecanol or from mixtures of C13- to $C_{15}$-alcohols.

In a preferred embodiment relates to the present compositions where R is an alkyl radical of the formula $C_5H_{11}CH(C_3H_7)CH_2$—.

For example, the alcohols used according to the invention as starter compound may be Guerbet alcohols, in particular ethylhexanol, propylheptanol, butyloctanol. For this reason, the present invention also relates, in a particularly preferred embodiment, to a process where the starter compound is Guerbet alcohol.

The alcohols used as starter compound may, according to the invention, also be mixtures of different isomers.

In addition, secondary alcohols or mixtures are also suitable. These can be obtainable, for example, by the addition of ketones onto aldehydes with subsequent hydrogenation, as described in DE 100 35 617.6. Preference is given here to methyl ketones, such as acetone, methyl ethyl ketone or methyl isobutyl ketone. Also suitable are paraffin oxidation products which arise, for example, as a result of Bashkirov oxidation. Preference is given here to products of $C_1$-$C_{16}$-paraffin mixtures, particularly products of $C_{12-14}$-paraffin mixtures. Suitable alcohols are also, for example, secondary alcohols, which are obtained through the addition of water onto olefins or by free-radical or other oxidation of olefins.

In the preparation of the compositions according to the invention, double-metal cyanide compounds can, for example, be used as catalyst. The compositions according to the invention obtained in this way can have a residual metal content of more than 0 and less than 50 ppm of zinc (i.e. mg of metal per kg of product), in particular greater than 0 and less than 25 ppm of zinc or preferably greater than 0 and less than 15 ppm of zinc and greater than 0 and less than 25 ppm of cobalt, in particular greater than 0 and less than 15 ppm of cobalt or preferably greater than 0 and less than 7 ppm of cobalt.

For this reason, the present invention provides, in a further embodiment, compositions whose content of zinc is greater than 0 and less than or equal to 15 ppm or whose content of cobalt is greater than 0 and less than or equal to 7 ppm, or whose content of zinc is greater than 0 and less than or equal to 15 ppm and whose content of cobalt is greater than 0 and less than or equal to 7 ppm.

Moreover, the present invention also provides a process for the preparation of compositions at least comprising one alkoxylate of the formula I by reacting at least one alcohol ROH with propylene oxide and ethylene oxide under alkoxylation conditions.

By carrying out, as is preferred according to the invention, firstly propoxylation and only then ethoxylation, the content of residual alcohol in the alkoxylates can be reduced since propylene oxide is added evenly to the alcohol component. In contrast to this, ethylene oxide reacts preferentially with ethoxylates, meaning that, if ethylene oxide is used initially with the reaction for the alcohols, both a broad homolog distribution and also a high content of residual alcohol result. The avoidance of relatively large amounts of residual alcohol present in the product is advantageous particularly for odor reasons.

Surprisingly, it has been found that this effect arises even when the amounts of propylene oxide used are small, i.e. in accordance with the invention less than 1.5 equivalents, based on the alcohol used, in particular less than 1.2 equivalents, particularly preferably less than 1 equivalent.

The addition reaction is carried out in a closed vessel at temperatures of from about 90 to 240° C., preferably from 110 to 190° C. The alkylene oxide or the mixture of different alkylene oxides is passed to the mixture of alkanol mixture according to the invention and catalyst under the vapor pressure of the alkylene oxide mixture prevailing at the desired reaction temperature, or a higher pressure. If desired, the alkylene oxide can be diluted with an inert gas (for example noble gases, nitrogen, $CO_2$) up to 99.9%. Particularly in the case of ethylene oxide, this provides additional security against the gas-phase decomposition of this alkylene oxide, it being possible in this embodiment to also use a further alkylene oxide, for example propylene oxide, as inert gas for the purposes of the invention.

Suitable alkoxylation conditions are described in Nikolaus Schönfeldt, Grenzflächenaktive Athylenoxid-Addukte [Interface-active ethylene oxide adducts], Wissenschaftliche Verlagsgesellschaft mbH Stuttgart 1984. The alkoxylation is usually carried out in the presence of basic catalysts such as KOH without a diluent. The alkoxylation can, however, also be carried out with co-use of a solvent.

According to the invention, the alcohols are firstly reacted with a suitable amount of propylene oxide and then with a suitable amount of ethylene oxide. In the process, a polymerization of the alkylene oxide is set in motion, during which a random distribution of homologs inevitably arises, the average value of which is given in the present case by n and m.

The length of the polyether chains (n+m) varies within the reaction product statistically about a mean value which arises essentially from the amount added and the stoichiometric values. Varying molecular weight distributions are obtained depending on the catalyst used. Products with a narrow molecular weight distribution, for example, often have good solubility.

For example, the alkoxylation is catalyzed by strong bases which are expediently added in the form of the alkali metal alkoxylate, alkali metal hydroxide, alkaline earth metal oxide or alkaline earth metal hydroxide, usually in an amount of from 0.01 to 1% by weight, based on the amount of the alkanol $R^2$—OH. (Cf. G. Gee et al., J. Chem. Soc. (1961), p. 1345; B. Wojtech, Makromol. Chem. 66, (1966), p. 180).

An acidic catalysis of the addition reaction is also possible. As well as Bronsted acids, Lewis acids are also suitable, such as, for example, $AlCl_3$ or $BF_3$ dietherate, $BF_3$, $BF_3xH_3PO_4$, $SbCl_4x2H_2O$, hydrotalcite (cf. P. H. Plesch, The Chemistry of Cationic Polymerization, Pergamon Press, New York (1963)). Double-metal cyanide (DMC) compounds are also suitable as catalyst. In one embodiment, the present invention provides a process carried out in the presence of a double-metal cyanide compound as catalyst. For this reason, the present invention provides, in a preferred embodiment, a process for the preparation of compositions, where the alkoxylation takes place in the presence of a double-metal cyanide compound (DMC compound) as catalyst. The DMC compounds which can be used are in principle all suitable compounds known to the person skilled in the art.

DMC compounds suitable as catalysts are described, for example, in WO 99/16775 and DE 10117273.7. In particular, double-metal cyanide compound of the formula I are suitable as catalyst for the alkoxylation:

$$M^1_a[M^2(CN)_b(A)_c]_d.fM^1_gX_n.h(H_2O).eL.kP \quad (I)$$

in which $M^1$ is at least one metal ion chosen from the group consisting of $Zn^{2+}$, $Fe^{2+}$, $Fe^{3+}$, $CO^{3+}$, $Ni^{2+}$, $Mn^{2+}$, $Sn^{2+}$, $Pb^{2+}$, $Mo^{4+}$, $Mo^{6+}$, $Al^{3+}$, $V^{4+}$, $V^{5+}$, $Sr^{2+}$, $W^{4+}$, $W^{6+}$, $Cr^{2+}$, $Cr^{2+}$, $Cd^{2+}$, $Hg^{2+}$, $Pd^{2+}$, $Pt^{2+}$, $V^{2+}$, $Mg^{2+}$, $Ca^{2+}$, $Ba^{2+}$, $Cu^{2+}$, $La^{3+}$, $Ce^{3+}$, $Ce^{4+}$, $Eu^{3+}$, $Ti^{3+}$, $Ti^{4+}$, $Ag^{+}$, $Rh^{2+}$, $Rh^{3+}$, $Ru^{2+}$, $Ru^{3+}$, $M^2$ is at least one metal ion chosen from the group consisting of $Fe^{2+}$, $Fe^{3+}$, $Co^{2+}$, $Co^{3+}$, $Mn^{2+}$, $Mn^{3+}$, $V^{4+}$, $V^{5+}$, $Cr^{2+}$, $Cr^{3+}$, $Rh^{3+}$, $Ru^{2+}$, $Ir^{3+}$, A and X, independently of one another, are an anion chosen from the group consisting of halide, hydroxide, sulfate, carbonate, cyanide, thiocyanate, isocyanate, cyanate, carboxylate, oxalate, nitrate, nitrosyl, hydrogensulfate, phosphate, dihydrogenphosphate, hydrogenphosphate or hydrogencarbonate, L is a water-miscible ligand chosen from the group consisting of alcohols, aldehydes, ketones, ethers, polyethers, esters, polyesters, polycarbonate, ureas, amides, primary, secondary and tertiary amines, ligands with pyridine nitrogen, nitriles, sulfides, phosphides, phosphites, phosphanes, phosphonates and phosphates, k is a fraction or integer greater than or equal to zero, and P is an organic additive, a, b, c, d, g and n are chosen such that the electroneutrality of the compound (I) is ensured, where c may be 0, e is the number of ligand molecules a fraction or integer greater than 0, or 0, f and h, independently of one another, are a fraction or integer greater than 0, or 0.

Organic additives P which can be mentioned are: polyethers, polyesters, polycarbonates, polyalkylene glycol sorbitan esters, polyalkylene glycol glycidyl ethers, polyacrylamide, poly(acrylamide-co-acrylic acid), polyacrylic acid, poly(acrylamide-co-maleic acid), polyacrylonitrile, polyalkyl acrylates, polyalkyl methacrylates, polyvinyl methyl ether, polyvinyl ethyl ether, polyvinyl acetate, polyvinyl alcohol, poly-N-vinylpyrrolidone, poly(N-vinylpyrrolidone-co-acrylic acid), polyvinyl methyl ketone, poly(4-vinylphenol), poly(acrylic acid-co-styrene), oxazoline polymers, polyalkyleneimines, maleic acid and maleic anhydride copolymers, hydroxyethylcellulose, polyacetates, ionic surface-active and interface-active compounds, bile acid or salts thereof, esters or amides, carboxylic esters of polyhydric alcohols and glycosides.

These catalysts may be crystalline or amorphous. When k is zero, crystalline double-metal cyanide compounds are preferred. When k is greater than zero, both crystalline, partially crystalline and also substantially amorphous catalysts are preferred.

There are various preferred embodiments of the modified catalysts. A preferred embodiment covers catalysts of the formula (I) in which k is greater than zero. The preferred catalyst then comprises at least one double-metal cyanide compound, at least one organic ligand and at least one organic additive P.

In another preferred embodiment, k is zero, optionally e is also zero and X is exclusively a carboxylate, preferably formate, acetate and propionate. Such catalysts are described in WO 99/16775. In this embodiment, preference is given to crystalline double-metal cyanide catalysts. Also preferred are double-metal cyanide catalysts as described in WO 00/74845, which are crystalline and platelet-like.

The modified catalysts are prepared by combining a metal salt solution with a cyanometallate solution, which may optionally contain both an organic ligand L and also an organic additive P. Subsequently, the organic ligand and optionally the organic additive are added. In a preferred embodiment of the catalyst preparation, an inactive double-metal cyanide phase is firstly prepared, and this is then converted into an active double-metal cyanide phase by recrystallization, as described in PCT/EP01/01893.

In another preferred embodiment of the catalysts, f, e and k do not equal zero. These are double-metal cyanide catalysts which contain a water-miscible organic ligand (generally in amounts of from 0.5 to 30% by weight) and an organic additive (generally in amounts of from 5 to 80% by weight), as described in WO 98/06312. The catalysts can either be prepared with vigorous stirring (24 000 rpm using Turrax) or with stirring, as described in U.S. Pat. No. 5,158,922.

Particularly suitable catalysts for the alkoxylation are double-metal cyanide compounds which contain zinc, cobalt or iron or two thereof. Berlin blue, for example, is particularly suitable.

Preference is given to using crystalline DMC compounds. In a preferred embodiment, a crystalline DMC compound of the Zn-Co type which comprises zinc acetate as further metal salt component is used as catalyst. Such compounds crystallize in monoclinic structure and have a platelet-like habit. Such compounds are described, for example, in WO 00/74845 or PCT/EP01/01893.

DMC compounds suitable as catalysts may, in principle, be prepared by all ways known to the person skilled in the art. For example, the DMC compounds can be prepared by direct precipitation, incipient wetness method, by preparing a precursor phase and subsequent recrystallization.

The DMC compounds can be used powder, paste or suspension, or be molded to give a shaped body, be converted to moldings, foams or the like, or be applied to moldings, foams or the like.

The catalyst concentration used for the alkoxylation, based on the final quantity structure, is typically less than 2000 ppm (i.e. mg of catalyst per kg of product), preferably less than 1000 ppm, in particular less than 500 ppm, especially preferably less than 100 ppm, for example less than 50 ppm or 35 ppm, especially preferably less than 25 ppm.

The compositions according to the invention exhibit good wetting on hard surfaces. The advantageous wetting behavior of the mixtures according to the invention can be determined, for example, by contact angle measurements on glass, polyethylene oxide or steel.

For this reason, the present invention also provides for the use of a composition according to the invention or a composition prepared by a process according to the invention as emulsifier, foam regulator or as wetting agent for hard surfaces, in particular for use in detergents, surfactant formulations for the cleaning of hard surfaces, humectants, cosmetic, pharmaceutical and crop protection formulations, paints, coating compositions, adhesives, leather-degreasing compositions, formulations for the textile industry, fiber processing, metal processing, food industry, water treatment, paper industry, fermentation or mineral processing and in emulsion polymerizations.

The improved wetting behavior of the compositions according to the invention results in a better performance in the case, in particular, of rapid cleaning processes. This is surprising since extending the chain of the starting alcohol usually reduces the dynamic and wetting properties. Using the compositions according to the invention, it is thus possible to increase the wetting rate of aqueous formulations. The compositions according to the invention can thus also be used as solubilizers which, in particular, do not have a negative effect, but a positive effect, on the wetting ability of wetting auxiliaries even in dilute systems. They can be used for increasing the solubility of wetting auxiliaries in aqueous formulations which comprise nonionic surfactants. They serve, in particular, to increase the wetting rate in aqueous wetting compositions.

In addition, the compositions according to the invention serve to reduce the interfacial tension, for example in aqueous surfactant formulations. The reduced interfacial tension can, for example, be determined by the pendant-drop method. This also results in a better effect of the compositions according to the invention as emulsifier or coemulsifier. The compositions according to the invention can also be used for reducing the interfacial tension in short times of customarily less than one second, or for accelerating the establishment of the interfacial tension in aqueous surfactant formulations.

Preferred fields of use for the compositions according to the invention are described in more detail below.

The compositions according to the invention are preferably used in the following fields:

Surfactant formulations for the cleaning of hard surfaces: suitable surfactant formulations to which the alkoxylates according to the invention can be added are described, for example, in Formulating Detergents and Personal Care Products by Louis Ho Tan Tai, AOCS Press, 2000.

They comprise, for example, as further components soap, anionic surfactants, such as LAS or paraffinsulfonates or FAS or FAES, acid such as phosphoric acid, amidosulfonic acid, citric acid, lactic acid, acetic acid, other organic and inorganic acids, solvents, such as ethylene glycol, isopropanol, complexing agents, such as EDTA, NTA, MGDA, phosphonates, polymers, such as polyacrylates, copolymers of maleic acid-acrylic acid, alkali donors, such as hydroxides, silicates, carbonates, perfume oil, oxidizing agents, such as perborates, peracids or trichloroisocyanuric acid, Na or K dichloroisocyanurates, enzymes; see also Milton J. Rosen, Manilal Dahanayake, Industrial Utilization of Surfactants, AOCS Press, 2000 and Nikolaus Schönfeldt, Grenzflächenaktive Ethylenoxidaddukte [Interface-active ethylene oxide adducts]. This also covers, in principle, formulations for the other applications mentioned. They may be household cleaners, such as all-purpose cleaners, dishwashing detergents for manual and automatic dishwashing, metal degreasing, industrial applications, such as cleaners for the food industry bottlewashing etc. They may also be printing roll and printing plate cleaners in the printing industry. Suitable further ingredients are known to the person skilled in the art.

Humectants, in particular for the printing industry.

Cosmetic, pharmaceutical and crop protection formulations. Suitable crop protection formulations are described, for example, in EP-A-0 050 228. Further ingredients customary for crop protection compositions may be present.

Paints and coating compositions, pigment preparations and adhesives in the coatings and polymer film industry.

Leather-degreasing compositions.

Formulations for the textile industry, such as leveling agents or formulations for yarn cleaning.

Fiber processing and auxiliaries for the paper and pulp industry.

Metal processing, such as metal finishing and electroplating sector.

Food industry.

Water treatment and production of drinking water.

Fermentation.

Mineral processing and dust control.

Building auxiliaries.

Emulsion polymerization and preparation of dispersions.

Coolants and lubricants.

Such formulations usually comprise ingredients such as surfactants, builders, fragrances and dyes, complexing agents, polymers and other ingredients. Typical formulations are described, for example, in WO 01/32820. Further ingredients suitable for various applications are described, for example, in EP-A-0 620 270, WO 95/27034, EP-A-0 681 865, EP-A-0 616 026, EP-A-0 616 028, DE-A-42 37 178 and U.S. Pat. No. 5,340,495 and in Schönfeldt, see above.

Generally, the compositions according to the invention can be used in all fields in which the action of interface-active substances is necessary.

The present invention therefore also provides detergents, cleaners, wetting agents, coating compositions, adhesive compositions, leather-degreasing compositions, humectants or textile-treatment compositions or cosmetic, pharmaceutical or crop protection formulation comprising a composition according to the invention or a composition prepared by a process according to the invention. The products here preferably comprise 0.1 to 20% by weight of the compositions.

The compositions according to the invention are characterized in particular by a low residual alcohol content which can lead to odor nuisance, meaning that they are advantageously suitable for a large number of fields of application.

We claim:

1. A composition at least comprising one alkoxylate of the formula I:

$$RO(A)_n(B)_mH \quad (I)$$

in which

R is an alkyl radical of the formula $C_5H_{11}CH(C_3H_7)CH_2$—,

A is propyleneoxy,

B is ethyleneoxy, n is an integer or fraction where $0<n<1$, m is an integer or fraction where $2<m\leqq 14$, with the proviso that for R, isomer mixtures of an alkyl radical of the empirical formula $C_5H_{11}CH(C_3H_7)CH_2$— comprising

| | |
|---|---|
| 70 to 99% by weight | of a radical R1 in which $C_5H_{11}$ has the meaning n-$C_5H_{11}$ and |
| 1 to 30% by weight | of a radical R2 in which $C_5H_{11}$ has the meaning $C_2H_5CH(CH_3)CH_2$ and/or $CH_3CH(CH_3)CH_2CH_2$, |

are excluded, wherein the composition has a lower content of the residual alcohol than the residual alcohol content of the composition theoretically determined from a residual alcohol content of products containing only propylene oxide or only ethylene oxide, and wherein the content of zinc in the composition is greater than 0 and less than or equal to 15 ppm, or the content of cobalt is greater than 0 and less than or equal to 7 ppm, or the content of zinc is greater than 0 and less than or equal to 15 ppm and the content of cobalt is greater than 0 and less than or equal to 7 ppm.

2. A process for the preparation of compositions as defined in claim 1 by reacting at least one alcohol $C_5H_{11}CH(C_3H_7)CH_2$—OH with propylene oxide and thereafter with ethylene oxide under alkoxylation condition, wherein the alkoxylation is carried out in the presence of a double-metal cyanide compound as catalyst and wherein the content of zinc in the composition is greater than 0 and less than or equal to 15 ppm, or the content of cobalt is greater than 0 and less than or equal to 7 ppm, or the content of zinc is greater than 0 and less than or equal to 15 ppm and the content of cobalt is greater than 0 and less than or equal to 7 ppm.

3. A detergent, cleaner, wetting agent, coating composition, adhesive, leather-degreasing composition, humectant or textile-treatment composition or cosmetic, pharmaceutical or crop protection formulation comprising the composition as claimed in claim 1.

* * * * *